United States Patent [19]

Miwa

[11] Patent Number: 4,505,243

[45] Date of Patent: Mar. 19, 1985

[54] ELECTROMAGNETIC INJECTION CONTROL VALVE IN UNIT FUEL INJECTOR

[75] Inventor: Hiromichi Miwa, Yokohama, Japan

[73] Assignee: Nissan Motor Company, Limited, Japan

[21] Appl. No.: 610,871

[22] Filed: May 16, 1984

[30] Foreign Application Priority Data

Jul. 4, 1983 [JP] Japan ..... 58-121442
Jul. 22, 1983 [JP] Japan ..... 58-134186

[51] Int. Cl.[3] ..... F02M 57/02
[52] U.S. Cl. ..... 123/446; 123/458
[58] Field of Search ..... 123/458, 459, 446; 239/88, 89, 90, 91, 92, 93

[56] References Cited

U.S. PATENT DOCUMENTS 2,598,528 5/1952 French ..... 123/458
3,146,769 9/1964 Hall ..... 123/458
4,129,253 12/1978 Bader, Jr. et al. ..... 239/88

*Primary Examiner*—Ronald H. Lazarus

*Attorney, Agent, or Firm*—Leydig, Voit, Osann, Meyer and Holt, Ltd.

[57] ABSTRACT

A unit fuel injector suited to diesel engines, including an injection pump portion and an injection nozzle portion both constructed in a known manner and an improved electromagnetic injection control valve, which is a normally open valve to permit leak of fuel pressure from the pump portion and closes in response to an electrical pulse signal to thereby allow increase of the fuel pressure transmitted to the nozzle and resultant lifting of a valve normally closing the spray-holes. The injection control valve is provided with a back-pressure chamber to which fuel pressure leaking from the pump portion is transmitted through a pressure-balancing passage to act on the back end of the control valve member to thereby cancel a valve-opening force produced by the action of the same fuel pressure on the tip of the valve member. So, the effective area of the leak orifice defined between the tip portion of the valve member and the valve seat can be enlarged without the need of augmenting the electromagnetic force for seating of the valve, which results in rapid lowering of the injection pressure upon termination of the supply of the pulse signal.

4 Claims, 8 Drawing Figures

ELECTROMAGNETIC INJECTION CONTROL VALVE IN UNIT FUEL INJECTOR

BACKGROUND OF THE INVENTION

This invention relates to a unit fuel injector for a diesel engine, and more particularly to an electromagnetic injection control valve in the unit fuel injector.

In diesel engines each cylinder is equipped with a fuel injection nozzle to which pressurized liquid fuel is supplied from a fuel injection pump.

In a so-called unit fuel injector such as the one shown in U.S. Pat. No. 4,129,253, the fuel injection nozzle and an injection pump are united into a single compact device together with an electromagnetic control valve to permit the injection nozzle to make fuel injection at suitable timing. Major advantages of such a unit fuel injector are attributed to the omission of a relatively long fuel injection pipe for connection of the injection nozzle to the pump. Naturally the injection time lag is reduced, and the injection pressure can be increased with a favorable effect on the atomization of fuel because the omission of a long injection pipe means a considerable decrease in the volume of fuel to be pressurized. Besides, the rate of fuel injection can be augmented and dribbling of fuel after the termination of injection can be lessened.

In a unit fuel injector, fuel at a relatively low pressure is supplied from a fuel tank by means of a fuel pump to a pressure chamber in the injection pump portion where the fuel is intensely pressurized. The injection nozzle portion of the unit injector has a needle valve to normally close the spray-holes, and when the pressure of fuel transmitted from the injection pump portion reaches a predetermined valve-opening pressure the needle valve lifts to open the spray-holes. The electromagnetic injection control valve is a normally open valve provided to a fuel passage connecting the pressure chamber in the injection pump portion to the fuel tank. Therefore, the fuel pressure in the pressure chamber leaks out through this control valve and, hence, does not reach the aforementioned valve-opening pressure so long as the control valve remains in the open position. The electromagnetic control valve closes in response to an electrical current pulse signal supplied from a fuel injection control circuit. Then the pressure of fuel in the pressure chamber begins to effectively increase and soon exceeds the valve-opening pressure in the nozzle portion to cause injection of fuel. Upon termination of the supply of the pulse signal, the electromagnetic control valve returns to its open position by the force of a spring to result in lowering of the fuel pressure in the injection pump portion and nozzle portion and then termination of fuel injection.

At the end of fuel injection, rapid lowering of the injection pressure is desired with a view to realizing clean cut-off of injection. In a unit fuel injector the rate of lowering of the injection pressure depends on the effective area of a leak orifice defined in the control valve between a valve seat and a tip portion of a needle valve, and the effective area of this orifice is limited by the maximum amount of the lift of the valve. One method of increasing the leak orifice area is to diametrically enlarge the valve seat. However, enlargement of the valve seat needs to be accompanied by augmentation of the electromagnetic force for seating of the valve. For example, where the injection pressure is about 1000 atm the seating of the valve requires a force of about 30 kgf or more even though the valve seat diameter is as small as about 2 mm. A substantial augmentation of the electromagnetic force to enlarge the valve seat naturally results in enlargement of the size of the electromagnetic control valve and, besides, raises difficulty in realizing quick responsiveness of the electromagnetic control valve required for application of the unit fuel injector to a compact and high-speed diesel engine. Another method of increasing the leak orifice area is to increase the maximum amount of the valve lift. This means an increase in the gap between the armature and core of the electromagnetic device. Since the electromagnetic force required for attraction of the armature is proportional to the square of the gap width, when the maximum amount of the valve lift is increased the electromagnetic force must be augmented in proportion to the square of the increased valve lift. This is unfavorable for the reasons explained above.

SUMMARY OF THE INVENTION

It is an object of the present invention to provide a unit fuel injector having an improved electromagnetic injection control valve in which the effective area of the aforementioned leak orifice can be increased without the need of increasing the electomagnetic force for seating of the valve so that the fuel injector becomes excellent in the manner of cut-off of fuel injection.

A unit fuel injector according to the invention for an internal combustion engine includes an injection pump portion having a pressure chamber which includes an end portion of a cylinder in which a pump plunger reciprocates in synchronism with revolutions of the engine, an injection nozzle portion having a valve disposed in a valve chamber communicating with the aforementioned pressure chamber so as to normally remain in its closed position to close spray-holes and lift to its open position when the fuel pressure transmitted from the pressure chamber to the valve chamber increases to a predetermined level, and an electromagnetic injection control means which is provided to a fuel passage extending from the pressure chamber of the pump portion and has a valve member normally kept in its open position by a resilient biasing means such that a fuel pressure transmitted from the pressure chamber through the aforementioned fuel passage acts on a tip portion of the valve member and an electromagnetic means for bringing the valve member into its closed position is response to an electrical current pulse signal to thereby prevent leak of the fuel pressure in the pressure chamber through the mentioned fuel passage. This fuel injector is characterized in that the electromagnetic control valve means has a back-pressure chamber defined in a supplementary cylinder into which a cylindrical member in the form of an axial extension of the aforementioned valve member fits and a pressure-balancing passage through which the fuel pressure transmitted from the pressure chamber and acting on the tip portion of the valve body is transmitted to the back-pressure chamber.

Conveniently the pressure-balancing passage can be formed as an axial through-hole bored in the valve member.

The combination of the back-pressure chamber and the pressure-balancing passage has the effect of balancing a "valve-opening force" produced by the fuel pressure acting on the tip of the valve member with a "valve-closing force" produced by the action of the fuel pressure in the back-pressure chamber on the rear end of the same valve member. Therefore, the fuel pressures have little influence on the closing movement of the valve member so that a relatively weak electromotive force suffices for seating of the valve member. For this reason, it has become possible to diametrically enlarge the valve seat and thereby enlarge the effective area of the aforementioned leak orifice without the need of augmenting the electromagnetic force for seating of the valve member.

DESCRIPTION OF THE PREFERRED EMBODIMENTS

Figure 1:
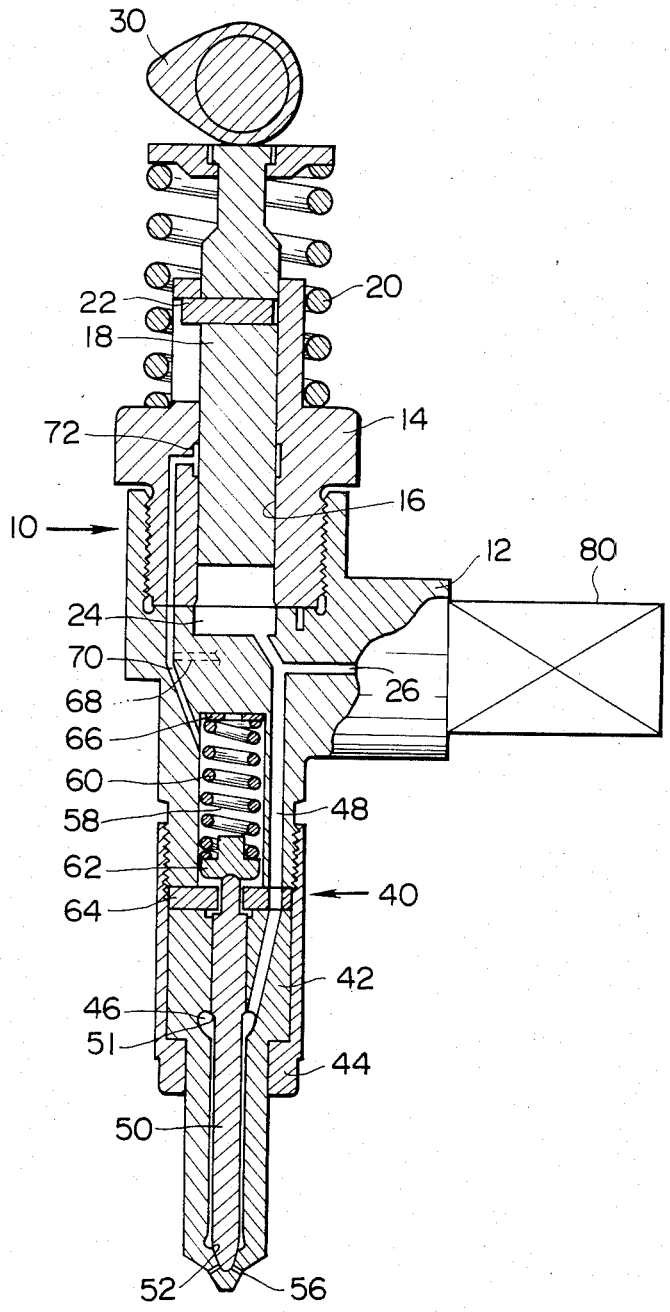
FIG. 1 is a schematic and partly sectional illustration of a unit fuel injector to which the present invention is applied, showing a general construction of the injector.
Figure 2:
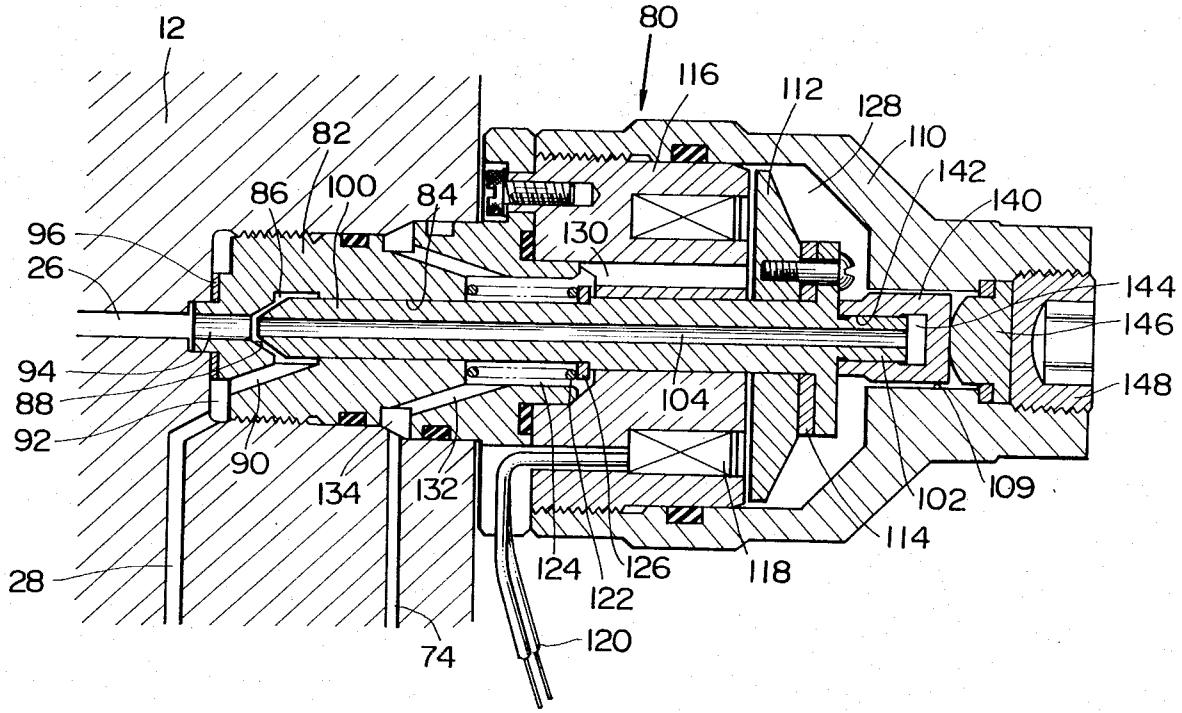
FIG. 2 is an enlarged and longitudinal sectional view of an electromagnetic fuel injection control valve according to the invention as a part of the unit fuel injector of FIG. 1.

FIG. 1 shows a general construction of a unit fuel injector for a diesel engine, which consists of a pump portion 10, a fuel injection nozzle portion 40 and an electromagnetic fuel injection control valve portion 80 according to the invention. The construction of the control valve portion 80 is shown in FIG. 2.

In the pump portion 10 a bushing 14 is threaded in a main body 12 of the injector to provide a cylinder 16 in which a pump plunger 18 is slidably received. A protruding end portion of the plunger 18 serves as a follower that is reciprocated by a cam 30 rotating in synchronism with the engine. A plunger return spring 20 is installed in a conventional manner so as to bias the plunger 18 toward the cam 30, and a stop pin 22 is inserted in the bushing 14 to limit the movement of the plunger 18 in the direction toward the cam 30. The opposite end face of the plunger 18 bounds a fluid pressure chamber 24 which includes an end portion of the cylinder 16 and is in flow communication with a fuel tank (not shown) via a fuel delivery passage 26.

In the injection nozzle portion 40 a generally cylindrical nozzle body 42 is mounted on a cylindrical and threaded end portion of the main body 12 and retained by a nut 44 threaded to the body 12. The hollow in the nozzle body 42 provides a needle chamber 46 which is in communication with the pressure chamber 24 through a fuel passage 48. A needle valve 50 is disposed in the nozzle body 42, and the inner surface of the nozzle body 42 at the tip thereof is so shaped as to provide a tapered annular valve seat 52. Spray-holes 56, which open into a cylinder of the engine (not shown), are bored in the nozzle body 42 such that the inside mouth of every spray-hole 56 is contained in the valve seat surface 52. A coil spring 60 and a spring guide 62 are disposed in a spring chamber 58 formed in the body 12 so as to bias the needle valve 50 toward the valve seat 52 and keep the valve 50 in the seated position to thereby close the spray-holes 56. In a middle section the needle valve 50 has a tapered surface 51 to produce a force opposing the force of the spring 60 by using a fluid pressure applied to the needle chamber 46. Indicated at 64 is a distance piece placed between the nozzle body 42 and the end of the main body 12 to limit the lift of the needle valve 50, and at 66 is a shim used to adjust the force of the spring 60. The spring chamber 58 communicates with a fuel return passage 68 via a fuel passage 70, which extends also to an annular groove 72 formed in the bushing 14 around an upper section of the cylinder 16.

During engine operation, the injection of fuel out through the spray-holes 56 occurs when a downward stroke of the pump plunger 18 increases the fuel pressure in the pressure chamber 24, and also in the needle chamber 46, to a level sufficient for lifting of the needle valve 50. However, for such an increase in the pressure of fuel in the pressure chamber 24 it is necessary to temporarily block the fuel passage 26 at suitable timing to thereby inhibit the return of fuel through this passage 26. The control valve portion 80 serves this purpose. The particulars of the pump portion 10 and the injection nozzle portion 40 shown in FIG. 1 are by way of example and may variously be modified in well known manners.

Referring to FIG. 2, in the control valve portion 80 a valve holder 82 in the form of bushing threaded into the main body 12 of the injector provides a cylinder 84 in which a needle valve 100 is slidably received. An end section of the cylinder 84 is slightly enlarged in diameter to provide a valve chamber 86 just above a tapered annular valve seat 88. The valve chamber 86 is in flow communication with a fuel delivery passage 28 extending from the fuel tank via a passage 90 bored in the valve holder 82 and an annular chamber 92 formed between an end face of the valve holder 82 and an inner surface of the body 12, and also with the fuel delivery passage 26 shown in FIG. 1 through a passage 94 which is bored in the valve holder 82 so as to have a port opposite to the tip of the needle valve 100. That is, the valve chamber 86 becomes a junction of the two fuel passages 26 and 28. Indicated at 96 is a seal.

In a housing 110 secured to the valve holder 82 an armature 112 is fixed to a flanged portion of the needle valve 100 with interposition of a shim 114, and an assembly of a core 116 and a solenoid coil 118 is stationarily disposed around a middle section of the needle valve so as to attract the armature 112 in the direction of the valve seat 88 upon energization of the solenoid coil 118. Indicated at 120 are leads to supply an electrical current pulse signal to the solenoid coil 118 from a conventional control circuit (not shown). A coil spring 122 is installed in a spring chamber 124 formed in the assembly of the valve holder 82 and the housing 110 by using a retainer 126 which is in abutment with an annular shoulder of the needle valve 100 to bias the needle valve 100 in the direction of the armature 112. Thus, the electromagnetic control valve 80 of FIG. 2 is a normally open valve that allows fuel to flow through the passages 26 and 28. A passage 130 provides flow communication between armature chamber 128 and spring chamber 124, which in turn communicates with a fuel return passage 74 via inclined passages 132 and an annular groove 134 in the valve holder 82. The above described fundamentals of the control valve 80 are well known.

According to the invention, the control valve 80 includes the following elements. A bushing 140 is fixed to the aforementioned flange of the needle valve 100 on the opposite side of the armature 112 to provide an additional cylinder 142 which is in axial alignment with the cylinder 84 in the valve holder 82, and a protruding end portion 102 of the needle valve 100 is so shaped as to fit into the additional cylinder 142. An end section 144 of the additional cylinder 142 bonded by the end face of the protruding portion 102 of the needle valve 100 is used as a back-pressure chamber. An axial through-hole 104 is bored in the center of the needle valve 100 including the protruding end portion 102 to utilize this hole 104 as a pressure-balancing passage through which a fluid pressure in the passage 94 formed opposite to the tip of the needle valve 100 is introduced into the back-pressure chamber 144. The bushing 140 has a cylindrically finished outer surface and slidably fits in a bore 109 of the housing 110. Indicated at 146 is a retainer to limit the movement of the bushing 140 together with the needle valve 100 and at 148 is a stopper lock threaded in the housing 110 to stationarily hold the retainer 146. The diameters of the protruding end portion 102 of the needle valve 100 and the pressure-balancing passage 104 are determined such that a valve-closing force produced by the action of the fluid pressure in the back-pressure chamber 144 becomes nearly equal to a valve-opening force produced by the action of a fluid pressure on the needle valve tip portion in the valve chamber 86.

During operation of the engine, the fuel injector of FIG. 1 including the electromagnetic injection control valve 80 of FIG. 2 functions in the following manner.

From a fuel pump (not shown) preliminarily pressurized fuel, but at a relatively low pressure, is supplied to the pressure chamber 24 in the pump portion 10 through the fuel passages 28 and 26 via the control valve 80 which is in its open position. As the pump plunger 18 is driven toward the pressure chamber 24 by the cam 30 rotating in synchronism with the engine, the pressure of fuel in the pressure chamber 24 begins to increase. However, the fuel pressure remains at a predetermined level which is insufficient to cause unseating of the needle valve 50 in the injection nozzle portion 40 since the increased pressure leaks out to the fuel passage 28 via the valve chamber 86 in the control valve portion 80. Meanwhile, a fuel pressure nearly equal to the pressure in the pressure chamber 24 is transmitted to the back-pressure chamber 144 through the pressure-balancing passage 104. Since the diameters of the protruding end portion 102 of the needle valve 100 and the passage 104 bored therein are determined in the above described manner, the force acting on the tip portion of the needle valve 100 is nearly balanced with the force acting on the rear end face bounding the back-pressure chamber 144. That is, the needle valve 100 is kept in the unseated position relative to the valve seat 88 only by the force of the spring 122, and the magnitude of a force required for seating of the needle valve 100 is scarcely influenced by an increase in the fuel pressure transmitted from the pressure chamber 24.

For closing of the control valve 80, it suffices that an electromagnetic force produced by the magnet 116, 118 overcomes the dead weights of the armature 112 and the needle valve 100 including the bushing 140 and the viscosity of the fuel. In other words, this control valve 80 can be closed by a relatively weak electromagnetic force even when the fuel is intensely pressurized. As an advantage of the control valve 80 according to the invention, the maximum diameter of the tapered tip portion of the needle valve 100 as well as the maximum diameters of the valve seat 88 can be made relatively large to thereby increase the leak orifice area without the need of significantly increasing the electromagnetic force for seating of the needle valve 100.

During the downward stroke of the pump plunger 18 and at a predetermined crank angle, a conventional control circuit (not shown) supplies an electrical current pulse signal of a finite pulse duration to the solenoid coil 118. The pulse duration is optimumly determined according to the engine operating conditions which may be monitored by using suitable sensors such as engine speed sensor, acceleration sensor detecting the degree of depression of the acceleration pedal, temperature sensor detecting the cooling water temperature and crank angle sensor. Then the armature 112 is attracted toward the core 116, causing the needle valve 100 to move toward and seat against the valve seat 88 with the effect of blocking the flow communication between the fuel passages 26 and 28. While the control valve 80 is in its closed position fuel confined in the pressure chamber 24 in the pump portion 10 undergoes a substantial increase in pressure, and the increased fuel pressure is transmitted to the needle chamber 46 in the nozzle portion 40 through the passage 48. When the pressure in the needle chamber 46 reaches a predetermined valve-opening pressure there occurs lifting of the needle valve 50 from the valve seat 52 to permit injection of fuel out through the spray-holes 56. After that the injection pressure continues to increase as the pump plunger 18 continues its downward stroke to further increase the fuel pressure in the pressure chamber 24.

An another predetermined crank angle the application of the pulse signal to the solenoid 118 is terminated to thereby allow lifting of the needle valve 100 from the valve seat 88 by the force of the spring 122. Then the greatly increased fuel pressure begins to leak out to the fuel passage 28 through an orifice defined between the valve seat 88 and the tip portion of the needle valve 100. Due to a resultant decrease in the fuel pressure transmitted to the needle chamber 46 in the nozzle portion 40, the needle valve 50 seats against the valve seat 52 to thereby close the spray-holes 56 and terminate the injection of fuel.

Figure 3:
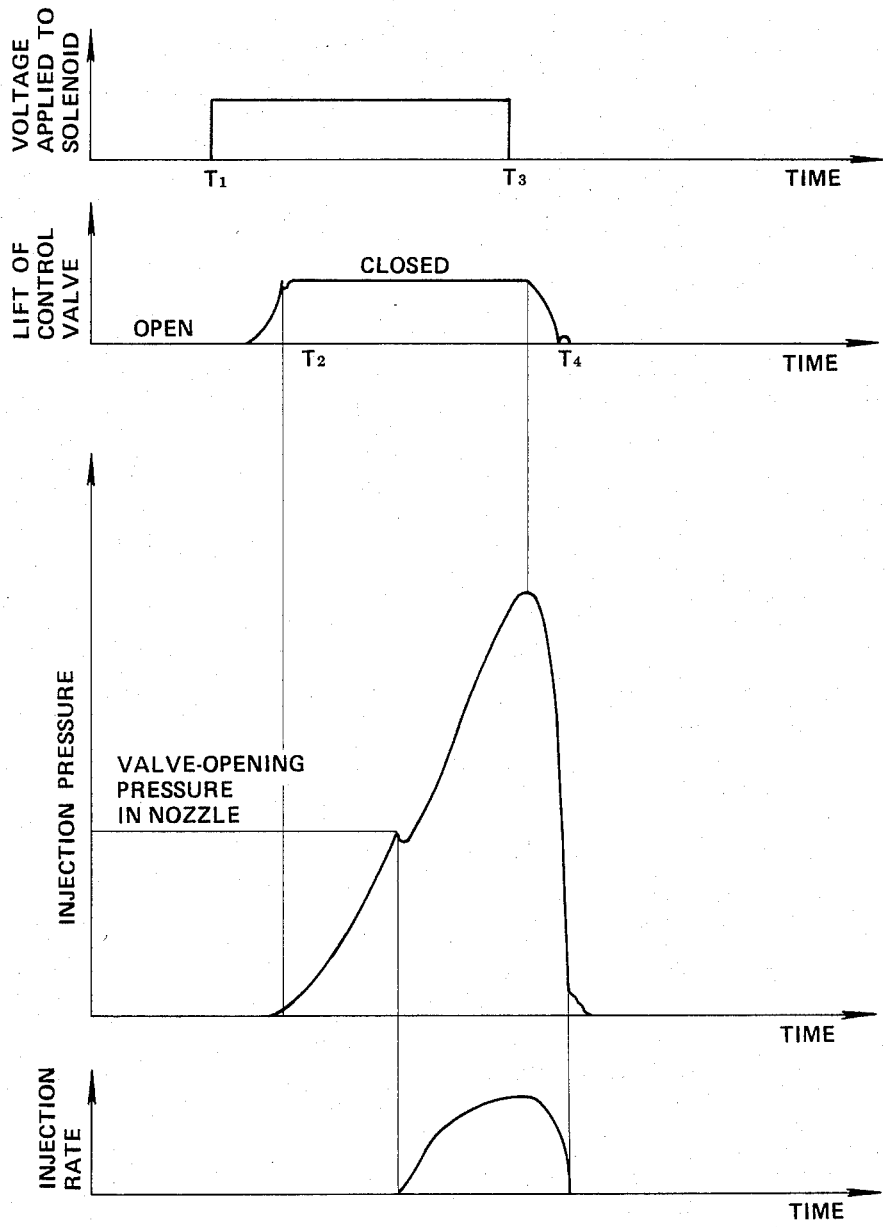
FIG. 3 is a chart showing the fuel injection characteristics of the injector of FIG. 1.

FIG. 3 illustrates the functional characteristics of the fuel injector of FIG. 1 including the control valve 80 of FIG. 2.

An electrical current is supplied to the solenoid coil 118 for the period between time points $T_1$ and $T_3$ to result in that, with a time lag, the control valve 80 remains in its closed position during the period between time points $T_2$ and $T_4$. After the lapse of a short time from the time point $T_2$, the pressure of fuel in the needle chamber 46 reaches the predetermined valve-opening pressure for the needle valve 50 with the effect of lifting the needle valve 50 to commence the injection of fuel through the spray-holes 56. After that the injection pressure, which can be taken as the pressure of fuel in the pressure chamber 24 in the pump portion 10, continues to increase until the time point $T_4$ followed by a corresponding increase in the injection rate. In the control valve 80 of FIG. 2, the maximum diameter of the tapered tip portion of the needle valve 100 as well as the maximum diameter of the valve seat 88 is made relatively large as mentioned hereinbefore. Accordingly the orifice defined between the valve seat 88 and the tip portion of the needle valve 100 in the unseated position becomes relatively large in its effective area, so that the leak of the fuel pressure through this orifice occurs at a relatively high rate. For this reason the lifting of the needle valve 100 from the valve seat 88 at the time point $T_4$ is soon followed by a sharp decrease in the injection pressure and a correspondingly sharp decrease in the injection rate. That is, this injector is excellent in the manner of cut-off of injection.

It is convenient to bore the through-hole 104 in the needle valve 100 to provide a passage to transmit the fuel pressure in the passage 94 to the back-pressure chamber 144, but this is not a requisite. Alternatively a pressure-balancing passage extending from the passage 94 to the back-pressure chamber 144 may be formed separately from the needle valve 100.

Figure 6:
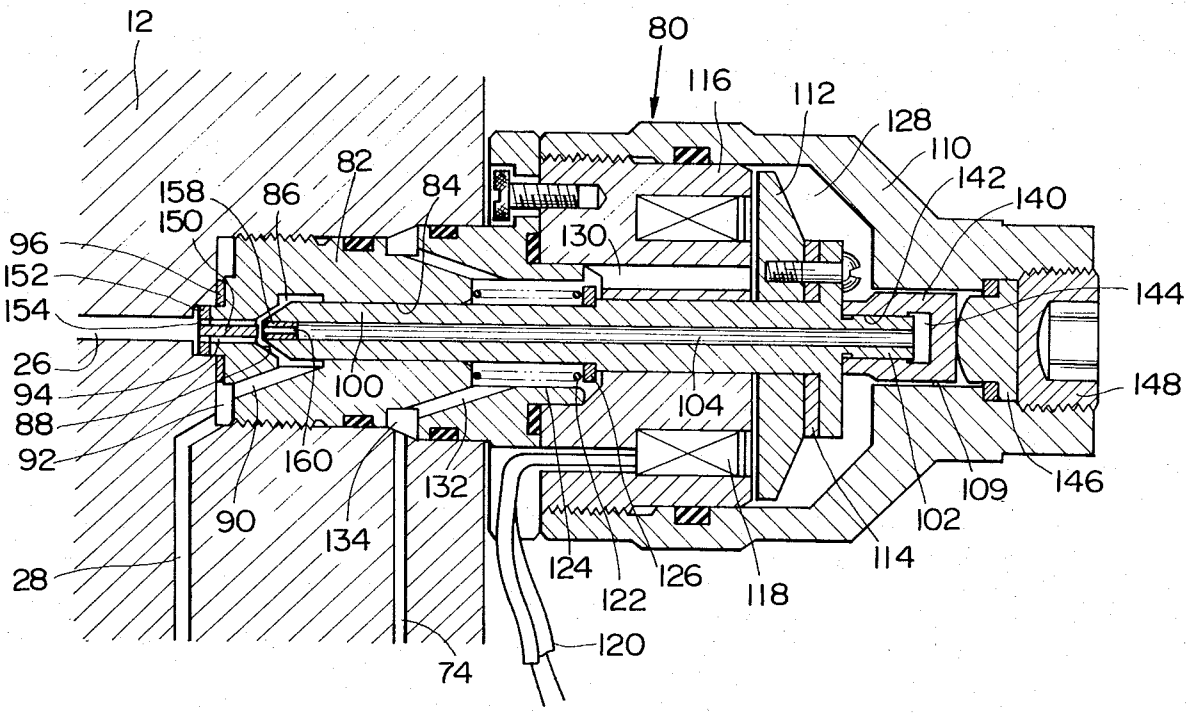
FIG. 6 shows a partial modification of the fuel injection control valve of FIG. 2, in a similarly enlarged and sectional view, as another embodiment of the invention.

Referring to FIG. 6, when the pressure-balancing passage 104 is the through-hole in the needle valve 100 as illustrated and the passage 94 bored in the valve holder 82 has a port opening to the valve chamber 86 at a location opposite to the tip of the needle valve 100, it is preferable to dispose a flow guide 150, which is a solid cylindrical member, in the center of the passage 94 to thereby render this passage 94 cross-sectionally annular. The reason is as follows.

Figure 4:
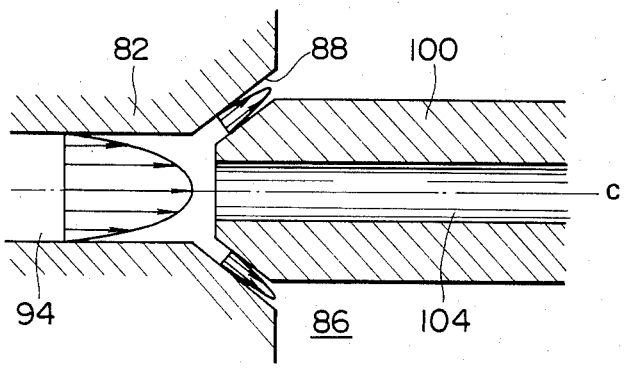
FIG. 4 is a sectional and schematic illustration of a tip portion of a needle valve in the device of FIG. 2.
Figure 5:
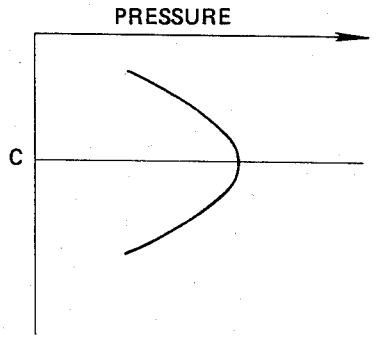
FIG. 5 is a related chart, for explanation of the manner of distribution of a fluid pressure acting on the tip of the valve in an unseated position.

FIG. 4 shows the tip portion of the needle valve 100 in the device of FIG. 2 in a state during its lifting from the valve seat 88 to terminate the injection of fuel. The arrows in FIG. 4 represent the distribution of stream lines of pressurized fuel. The high-pressure fuel flowing from the pressure chamber 24 in FIG. 1 passes through the passage 94 bored in the valve holder 82, and then partly leaks into the fuel delivery passage 28 through the orifice defined between the valve seat 88 and the tapered portion of the needle valve 100 and partly enters the pressure-balancing passage 104. However, the flow of fuel in the pressure-balancing passage 104 encounters resistance since the back-pressure chamber 144 at the end of this passage 104 is a closed chamber. Therefore, the velocity of the fuel flow in the port section of the passage 94 becomes relatively low in the center of the passage 94 and higher as the radial distance from the center becomes larger, so that the distribution of stream lines in this section of the passage 94 becomes as shown in FIG. 4. Naturally the distribution of fluid pressure acting on the end face of the needle valve 100 becomes as shown in FIG. 5: the pressure becomes maximum in the central area around the longitudinal axis C of the needle valve 100. Since the pressure-balancing passage 104 is bored in the center of the valve 100, relatively high pressures are transmitted to the back-pressure chamber 144 while relatively low pressures are acting on the annular area of the end face of the valve 100. That is, during lifting of the needle valve 100 from the valve seat 88 a fuel pressure having the effect of aiding the lift of the valve 100 becomes lower than another fuel pressure having the effect of pushing the valve 100 toward the valve seat 88. Since a valve-driving force attributed to the difference between such fuel pressures acts in the direction opposing the valve-opening force of the spring 122, the stableness of the functional characteristics of the electromagnetic control valve 80 is somewhat impaired.

The above described phenomenon is of meaning only when the function of the control valve 80 is very minutely analyzed and does not cancel the advantages of the control valve 80 of FIG. 2. Nevertheless, it is desirable to take certain countermeasures. It is an easy way to increase the force of the spring 122, but this is unfavorable because of the need of correspondingly increasing the electromagnetic force for seating of the needle valve 100 in contradiction to the primary object, i.e. increasing the effective area of the orifice between the valve seat 88 and the unseated valve tip portion without increasing the electromagnetic force.

In the control valve 80 of FIG. 6, the aforementioned flow guide 150 is employed as a solution of the above described problem. At one end the solid cylindrical flow guide 150 has a flange 152 which is firmly held between the valve holder 82 and the main body 12 of the injector, and through-holes 154 are bored in the flange 152 to establish flow communication between the fuel passage 26 and the passage 94 in which the flow guide 150 is disposed. The flow guide 150 is arranged coaxially with the through-hole 104 in the needle valve 100 with its end face at a very short distance from the tip of the valve 100 in the closed position. The diameter of the flow guide 150 is approximately equal to the diameter of the pressure-balancing passage 104, and the cross-sectional area of the annular passage 94 is made sufficiently larger than, preferably at least four times as large as, the effective area of the orifice defined between the valve seat 88 and the tip portion of the needle valve 100 in its open position in order to ensure a sufficient flow rate of fuel therethrough. In addition to the flow guide 150, preferably a bushing 158 is fitted into the end section of the through-hole 104 in the needle valve 100 to thereby form an orifice 160 of a small cross-sectional area opposite to the end face of the flow guide 150. This orifice 160 is made smaller in diameter than the flow guide 150. In other respects the control valve 80 of FIG. 6 is identical with the control valve 80 of FIG. 2.

Figure 7:
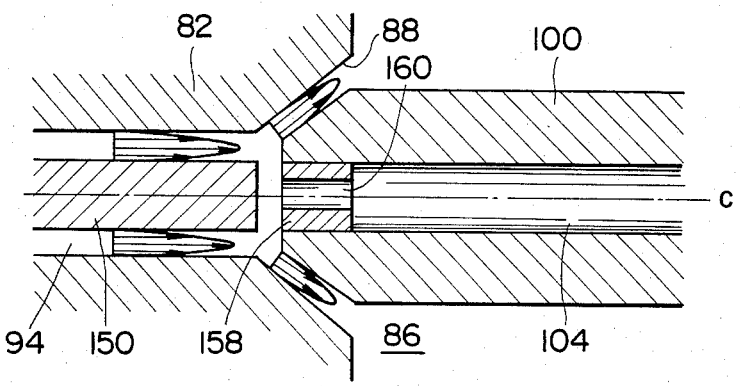
FIG. 7 is an explanatory illustration of the tip portion of the needle valve in the device of FIG. 6
Figure 8:
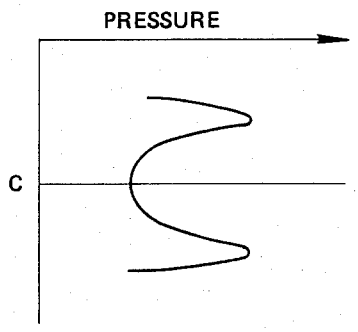
FIG. 8 is a related chart for comparison with FIGS. 4 and 5, respectively.

FIG. 7, which corresponds to FIG. 5, illustrates the effect of the flow guide 150 and the orifice 160 in the control valve 80 of FIG. 6. During lifting of the needle valve 100 from the valve seat 88, the distribution of stream lines in the annular passage 94 becomes as represented by the arrows, and, hence, the distribution of fluid pressure acting on the end face of the needle valve 100 becomes as shown in FIG. 8. In this case relatively high pressures act on the annular area of the end face of the valve 100 while relatively low pressures are transmitted through the pressure-balancing passage 104 to the back-ressure chamber 144. That is, a fuel pressure having the effect of aiding the lift of the valve 100 becomes higher than another fuel pressure having the effect of pushing the valve 100 toward the valve seat 88. Therefore, in this case the unbalance between the fuel pressure acting on the tip of the valve 100 and the fuel pressure in the back-pressure chamber 144 is not obstructive to, and is rather contributive to lifting of the valve 100 by the force of ths spring 122, so that the valve 100 is rapidly lifted to its fully open position. Thus, the modification shown in FIG. 6 is effective for improving the stableness of the functional characteristics of the electromagnetic control valve 80 without increasing the force of the spring 122 and the electromagnetic force, and also for further improving the manner of cut-off of fuel injection by lifting of the needle valve 100.

What is claimed is:

1. In a unit fuel injector for an internal combustion engine, the injector including an injection pump portion having a pressure chamber which includes an end portion of a cylinder in which a pump plunger reciprocates in synchronism with revolutions of the engine, an injection nozzle portion having a valve disposed in a valve chamber communicating with said pressure chamber so as to normally remain in its closed position to close spray-holes and lift to its open position when the fuel pressure transmitted from said pressure chamber to said valve chamber increases to a predetermined level, and an electromagnetic injection control valve means which is provided to a fuel passage extending from said pressure chamber and has a valve member normally kept in its open position by a resilient biasing means such that a fuel pressure transmitted from said pressure chamber through said fuel passage acts on a tip portion of the valve member and an electromagnetic means for bringing said valve member to its closed position in response to an electrical current pulse signal to thereby prevent leak of the fuel pressure in said pressure chamber through said fuel passage, the improvement comprising said electromagnetic injection control valve means has a back-pressure chamber defined in a supplementary cylinder into which a cylindrical member in the form of an axial extension of said valve member fits and a pressure-balancing passage through which the fuel pressure transmitted from said pressure chamber and acting on said tip portion of said valve member is transmitted to said back-pressure chamber.

2. A fuel injector according to claim 1, wherein said pressure-balancing passage is an axial through-hole bored in said valve member.

3. A fuel injector according to claim 2, wherein said tip portion of said valve member has an annular end face around a generally circular mouth of said through-hole and said fuel passage has a port opening into a valve chamber in which said tip portion of said valve member exists at a location opposite to said annular end face of said valve member, the injection control valve means further comprising a flow guide which is a solid and generally cylindrical member disposed in said fuel passage substantially coaxially with said valve member such that an end face of said flow guide is located in said port opposite to and spaced from said mouth of said through-hole, said mouth of said through-hole being smaller in diameter than said flow guide.

4. A fuel injector according to claim 3, wherein said valve member is fitted with a generally cylindrical bushing which is tightly inserted into a mouth section of said through-hole to provide an orifice which opens into said valve chamber at said end face of said valve member and is smaller in diameter than said flow guide.

* * * * *